US006694535B1

(12) United States Patent
Gianesi Gschwind

(10) Patent No.: US 6,694,535 B1
(45) Date of Patent: Feb. 24, 2004

(54) SEMI-PERMEABLE AND PARTLY FLUSHABLE POTTY LINER

(76) Inventor: Donata Marialuisa Gianesi Gschwind, Raingässli 35, Meilen ZH CH-8706 (CH)

( * ) Notice: Subject to any disclaimer, the term of this patent is extended or adjusted under 35 U.S.C. 154(b) by 0 days.

(21) Appl. No.: 10/338,111

(22) Filed: Jan. 9, 2003

(51) Int. Cl.[7] ..... A47K 13/24
(52) U.S. Cl. ..... 4/245.3; 4/484
(58) Field of Search ..... 4/245.5–245.9, 4/484, 245.3; 383/4, 71; 229/87.03

(56) References Cited

U.S. PATENT DOCUMENTS 4,980,247 A * 12/1990 Nakajima ..... 429/34
5,778,458 A * 7/1998 Speelman ..... 4/452
6,112,339 A * 9/2000 Nichols et al. ..... 4/484
6,115,855 A * 9/2000 Lorenzo ..... 4/484

* cited by examiner

*Primary Examiner*—Charles E. Phillips

(57) ABSTRACT

The present invention discloses a potty liner 1 made of a semi-permeable liner sheet 2 of very light material. Facing sides of the liner sheet 2 are provided with elastic members 3 and a perforation 4. The contraction of the elastic members 3 gives the liner sheet 2 a bag like shape with three open sides 8. Soft, flexibel and very light the contracted potty liner 1 is inserted easily in varying shapes of a child potty 6 and held in place by the elastic members 3 wrapped around the rim of the potty 6. On removing the potty liner 1 the contracted liner sheet 2 retains the solid waste, while liquids are emptied with the potty 6. The elastic members 3 are tom off along the perforation 4 for disposal in the garbage. The rest of the liner sheet 2 is flushed down the toilet together with the human solid waste. The potty liner 1 helps a parent or caretaker 7 to easily dispose of human solid wastes, i.e. in a decent, hygenic and ecologically acceptable way.

1 Claim, 2 Drawing Sheets

SEMI-PERMEABLE AND PARTLY FLUSHABLE POTTY LINER

BACKGROUND OF THE INVENTION

As a baby learns to use the potty and up until it grows big enough to use the toilet, a parent or caretaker will instead of having to change diapers clean out the potty. While liquids don't leave traces, the "big job" leaves traces, first in the potty, second after dumping in the toilet and last, on the parent's or caretaker's hand due to the wiping out of the narrow baby potty. An objective of the invention is to make this dirty task easier with a simple to manufacture semi-permeable product of which only parts are flushed to avoid extra pressure on valuable water supplies.

DESCRIPTION OF THE PRIOR ART

A number of patents were issued for liners designed for child training potties for receiving bodily waste.

For example the U.S. Pat. No. 6,115,855 issued to Lorenzo on Sep. 12, 2000 describes a closable non-permeable liner.

The U.S. Pat. No. 6,112,339 issued to Nichols et al. on Sep. 5, 2000 describes a water-resistant liner. Another patent U.S. Pat. No. D0402,739 was issued to Mc Clements on Dec. 15, 1998 for an absorbent liner. U.S. Pat. No. D381,070 issued to Deniakis, et al. on Jul. 15, 1997 and U.S. Pat. No. D354,342 issued to Marshall-Smith on Jan. 10, 1995 also disclose non-permeable liners.

These potty liners must be thrown in the garbage together with their health endangering solids and liquids.

A permeable bedliner is described in U.S. Pat. No. 5,778,458 issued to Speelman on Jul. 14, 1998. A biodegradable liner is cut to fit exactly one model of bedpan shape. It is free of any member for holding the liner in place. After use it will be flushed entirely down the toilet.

The invention at issue relates generally to a biodegradably disposable liner sheet, made of very light natural material, e.g. viscose fleece, which is inserted into a child training potty and held in place by the elastic members of the potty liner wrapped around the rim of the potty. After usage of the potty, the liner is removed and thereby the elastic member contracts and mainly solid excreta stay in the semi-permeable liner. The elastic members are torn off the potty liner along the perforation and disposed in the garbage. The rest of the biodegradable potty liner containing the human waste can be placed directly into the toilet's drain and flushed. The liquid in the potty is flushed as well, thus, preventing waste containers from containing liquids which could possibly leak and cause health threatening hygenic situations.

The present invention overcomes the shortcomings of the prior art by providing a biodegradably disposable semi-permeable potty liner which is simple in manufacturing due to use of light material, therefore easily folded, packed and diffused, which is, furthermore, simple in use, adjustable to various potty shapes, held in place during use, environmentally acceptably disposable as well as reducing the cleaning of the used potty from wiping out to mere rinsing and, moreover, eliminating the additional cleaning of the toilet vessel after dumping.

DESCRIPTION OF THE DRAWINGS

An example of the present invention is shown in the drawings, throughout which similar numbers designate similar parts.

Figure 1:
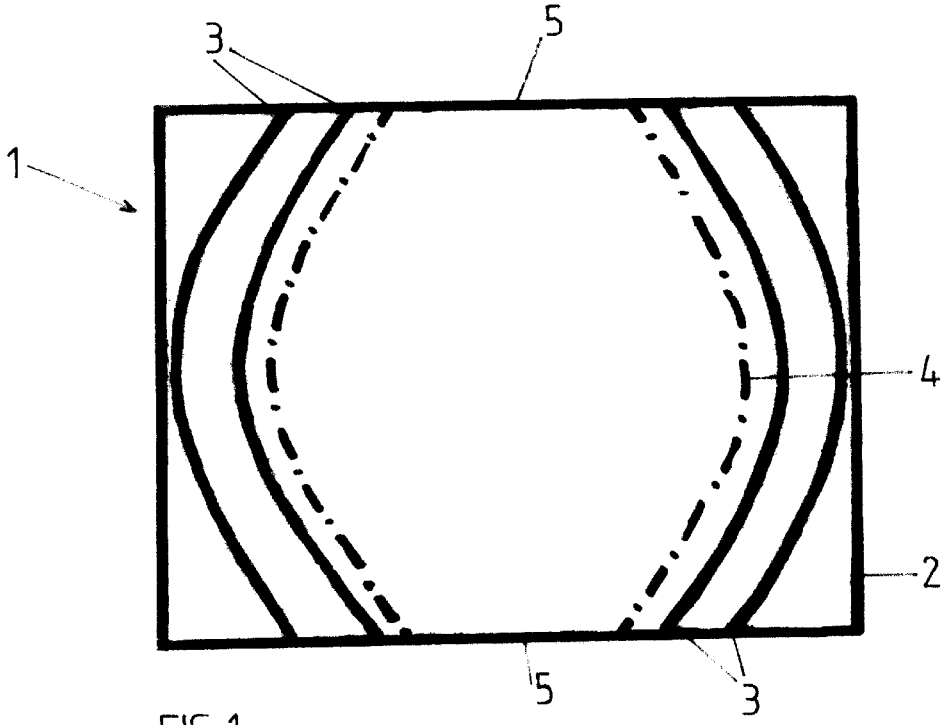
FIG. 1 shows a top view of the potty liner sheet spread flat.

The following numbering is used throughout the four views.

1 semi-permeable and partly flushable potty liner
2 liner sheet
3 elastic member
4 perforation
5 non-elastified section on liner sheet side
6 potty
7 parent or caretaker
8 openings at top and on sides of contracted potty liner

DESCRIPTION OF THE SEMI-PERMEABLE AND PARTLY FLUSHABLE POTTY LINER

The potty liner 1 is basically a square sheet 2 of biodegradable and semi-permeable light material, made of viscose, for example. Two facing sides of the liner sheet 2 are each provided with an elastic member 3 consisting of possibly two elastic bands running parallel across in a curved line. All along the inside bend of the elastic members 3 follows a parallel line of perforation 4. The described curves are easy to perform by a machine in the process of production.

The elastic members 3 of the liner sheet 2 contract and convert the flat liner sheet 2 into a bag like potty liner 1 with open top and sides 8.

Figure 2:
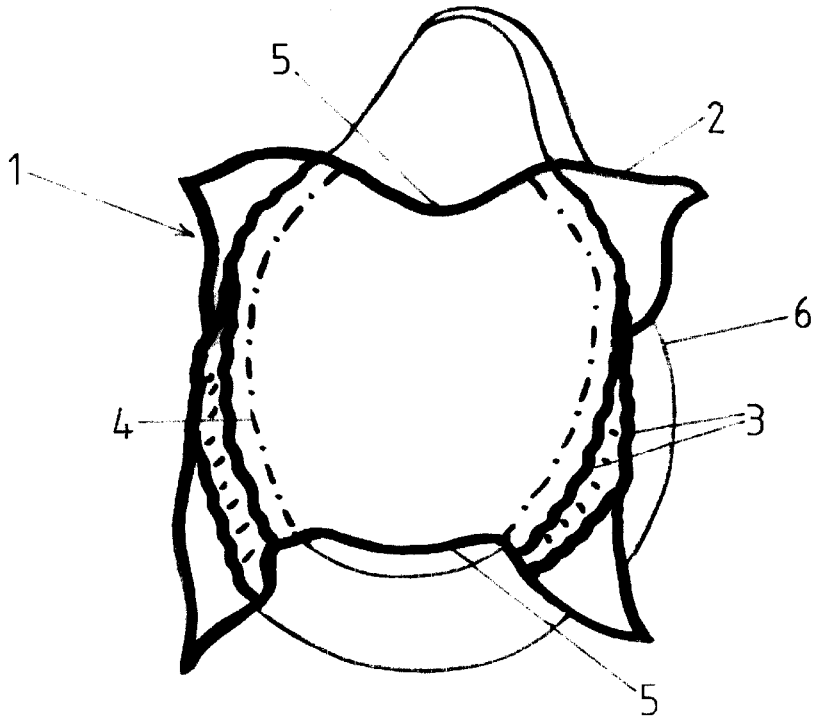
FIG. 2 shows a perspective view of the potty liner installed in a potty extending with the elastic members over the rim of the potty.
Figure 3:
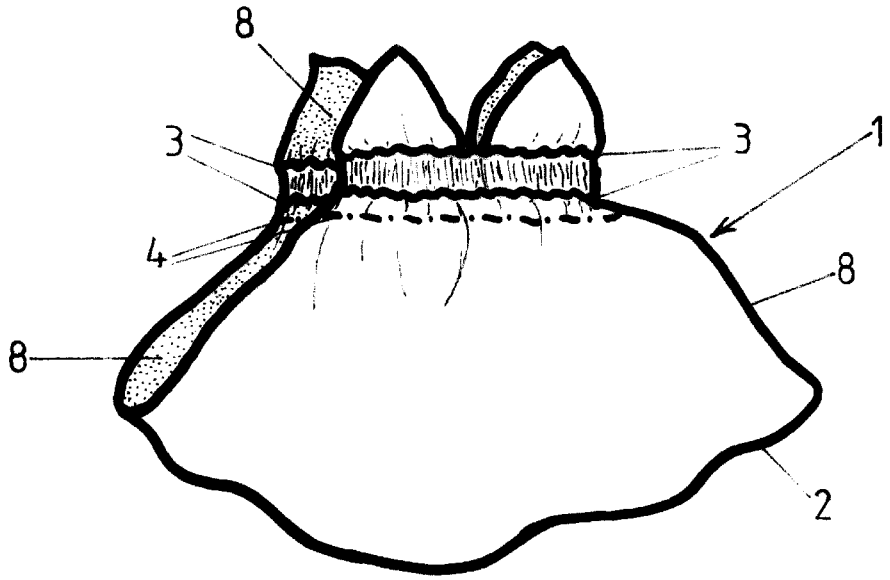
FIG. 3 shows a perspective view of the potty liner in full contraction.
Figure 4:
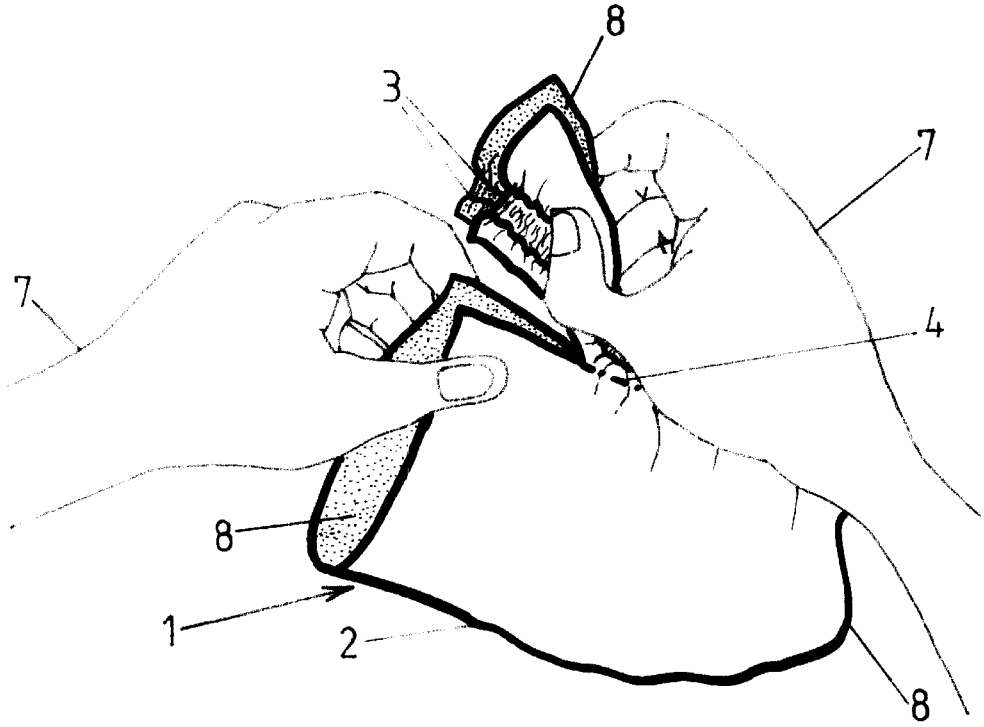
FIG. 4 shows a perspective view of a parent or caretaker tearing off the elastic members along the perforation of the contracted potty liner.

The bag like potty liner 1 is inserted in the hollow of the potty 6. The elastic members 3 on the potty liner 1 are wrapped over the rim of the potty 6. They hold the potty liner 1 in place in the potty 6. FIG. 2 also shows the sections 5 of the liner left without elastic members for eventual extras on a child training potty, e.g. a seatback and/or a handle or a bay for boys. These tension free sections 5 and the fact that the elastic members 3 have up to their maximum tensioned state any diameter wider than the diameter of a regular size child training potty 6, are the reasons why the potty liner 1 at issue can adjust to a variety of different potty models.

After completion of baby's "job" the parent or caretaker 7 carries the potty 6 to the toilet. Then, he holds on to the two elastified margins of the potty liner 1 and slips them over the rim of the potty 6. The bag like contracted potty liner 1 is easily drained through its open sides 8 into the potty 6. After this, the parent or caretaker 7 empties the merely liquid containing potty 6 into the toilet and puts the potty 6 down, while the bag like contracted potty liner 1 is held over the toilet. Now, the parent or caretaker 7 holds on to the two margins with the elastic members 3 and tears them together off along the perforation 4 of the potty liner 1 and deposits the rest of the potty liner 1 containing baby's solid waste directly in the drain of the toilet and flushes. The torn off margins with the elastic members 3 are disposed in the garbage. The potty 6 is rinsed and ready for further use.

With this procedure neither the potty 6 nor the hands of a parent or caretaker 7 gets in contact with the excreta and the toilet vessel is hardly dirty. By tearing off the elastic members 3 and disposing them in the garbage the remaining flushable liner sheet 2 does not put more pressure on valuable water supplies than a regular bowel movement does.

I claim:

1. A semi-permeable partly flushable potty liner 1 adjustable to various child training potties 6 comprising:

a. a liner sheet 2 made of natural material for receiving solid human excreta;

b. said liner sheet 2 being made out of at least one layer of semi-permeable material capable of passing fluid;

c. said liner sheet 2 having facing sides with separately mounted elastic members 3 running there along in a curve and a line of perforation 4 following said elastic member 3 parallel along the inside bend;

d. said liner sheet 2 being transformed by said elastic members 3 in contraction into a bag like potty liner 1 with an elastified margin forming an open top 8 said elastified top margin having two sections linking said open top 8 with the open sides 8;

e. said liner sheet 2 in contraction being inserted with its closed bottom into said child training potty 6;

f. said open top 8 of said contracted liner sheet 2 being wrapped by stretching said elastified members 3 over the rim of said child training potty 6;

g. said elastic members 3 of said liner sheet 2 leaving between a non elastified section of the liner sheet side 5 for attachments on the child training potty 6, such as a handle or a bay for boys or a seatback;

h. said liner sheet 2 contracting on removal after use by said elastic members 3 to a solid excreta retaining bag, letting fluids leak out said semi-permeable material and drain out the open sides 8;

i. after usage said elastic members 3 on said contracted liner sheet 2 being torn off at said lines of perforation 4 and being, disposed in the garbage and said liner sheet 2 without elastic members 3 possibly containing human solids being placed in the toilet drain and flushed as a simple sheet of biodegradable material.

* * * * *